US005552972A

United States Patent [19]

Rezvani

[11] Patent Number: 5,552,972

[45] Date of Patent: Sep. 3, 1996

[54] SELF-POWERED LIGHTED WHEEL

[76] Inventor: Vahid Rezvani, 11903 W. 148th St., Olathe, Kans. 66062

[21] Appl. No.: 345,905

[22] Filed: Nov. 28, 1994

[51] Int. Cl.[6] ..... F21L 13/00

[52] U.S. Cl. ..... 362/78; 362/103; 362/253; 280/811; 280/11.22

[58] Field of Search ..... 362/103, 61, 78, 362/800, 253, 811, 35; 280/809, 811, 11.22, 11.19, 816; 301/5.7, 5.3; 310/67 A, 67 R, 73

[56] References Cited

U.S. PATENT DOCUMENTS

| | | | |
|---|---|---|---|
| 2,505,154 | 4/1950 | Smith | 362/103 X |
| 4,298,910 | 11/1981 | Price | 362/103 X |
| 4,308,572 | 12/1981 | Davidson et al. | 362/103 |
| 4,363,502 | 12/1982 | Bakerman | 362/103 X |
| 4,367,515 | 1/1983 | Beard | 362/103 |
| 4,648,610 | 3/1987 | Hegyi | 362/800 X |
| 5,278,733 | 3/1993 | St. Thomas | 362/78 |

*Primary Examiner*—Denise L. Gromada
*Assistant Examiner*—Thomas M. Sember
*Attorney, Agent, or Firm*—Hovey, Williams, Timmons & Collins

[57] ABSTRACT

A lighted wheel which is preferably self-powered is provided which includes a rotatable wheel, an electrical power source connected to the wheel and a light-emitting member electrically coupled to the power source and carried by the wheel. The power source is preferably a dynamo carried by the wheel. The wheel preferably includes a traction tire and is a support wheel for use with a frame configured for supporting a person. The light emitting member can be a light bulb or a light-emitting diode mounted on the tire for displaying light when the wheel is rotated on the frame, such as a skate frame.

6 Claims, 2 Drawing Sheets

SELF-POWERED LIGHTED WHEEL

BACKGROUND OF THE INVENTION

1. Field of the Invention

This invention generally relates to rotatable wheels that display light during rotation and are provided with a power source for illuminating the wheel during use. More particularly, the wheels are intended for novelty use and carry the electrical power source so that a light-emitting or illuminating member carried by the wheel enables the wheel to provide self-illumination.

2. Description of the Prior Art

Novelty lighting for use with automobiles and shoes are becoming increasingly popular to provide a unique display. For example, automobiles may display neon lights directed from the frame toward the road surface underneath the vehicle or around the perimeter of a license plate. Shoes have been developed that include a small battery and a switch which illuminate a small lamp or light-emitting diode in the heel when weight is transferred to activate the switch. These items generate additional interest during use by virtue of their use of illumination.

However, such use of novelty lighting has not heretofore extended to use on wheels. While wheels are well known for use with automobiles, bicycles, skateboards and roller skates, the use of lighting to provide additional interest for those items has not been previously explored.

SUMMARY OF THE INVENTION

It is thus an object of this invention to provide a wheel which is capable of illumination during rotation.

It is another object of this invention to provide a wheel which is self-powered, which is to say carries both the illuminating member and a power source on the wheel structure.

It is another object of this invention to provide a wheel which generates its own power during use to supply electrical current to the wheel.

It is a further object of this invention to provide a wheel which may be used as a support wheel with a frame configured for supporting a person which displays lighting as the wheel rolls along the ground.

It is another object of this invention to provide a compact wheel for use with roller skates, skateboards or other devices where the illuminating member is carried by a traction tire.

It is another object of this invention to provide a wheel which has a flashing light, with the rate of flashing preferably corresponding to the rotational speed of the wheel.

These and other objects of the present invention are met by the self-powered lighted wheel of the present invention. That is to say, the wheel hereof advantageously mounts the light for rotation with the wheel, includes a compact power source, is capable of generating its own power when rotated during use, can be used in compact environments such as that presented by an in-line skate wheel, and is simply configured while providing further interest by the use of flashing or flickering lighting. One preferred embodiment is advantageously designed for use with a skate wheel and may use the bearings and traction tire from a conventional skate wheel, is of low weight, presents a low rolling resistance, and is operable at slow speeds so that even when rolling slowly, the wheel generates current sufficient to illuminate the lights.

The illuminated wheel of the present invention broadly includes wheel structure which preferably includes a wheel hub and tire, a power source such as a battery or dynamo, and an illuminating member such as a light-emitting diode or light bulb. As the wheel rotates, the illuminating member presents a unique effect by displaying the light to those nearby. The wheel hereof may be small and compact, such as a skate wheel for use with an in-line skate, and when a dynamo is used, only a modest additional effort is required which does not detract from the utility of the skate, skateboard, or other self-powered conveyance. However, the use of the invention hereof is not strictly limited to smaller supporting frames such as a roller skate, but may be used on larger conveyances such as bicycles, carriages and automobiles where permitted.

In particularly preferred embodiments, the lighted wheel hereof may be provided with light-emitting diodes and an AC dynamo. The dynamo is coupled to the light-emitting diodes to produce a flashing or flickering light through differently laid diodes as the current is alternated. Advantageously, the diodes are mounted on traction tires at an angle to display the light when viewed from the side or along the line of travel as the wheel turns, without affecting the portion engaging the road surface.

The dynamo hereof is particularly useful in the application as described which employs a brushless dynamo providing sufficient current to operate the diodes without the wear otherwise associated with dynamos having brushes. The dynamo is compact and fits neatly within the wheel hub to permit a standard traction tire to be used. By using a compact dynamo, a battery need not be replaced while a conventional traction tire may be employed such as with in-line skate wheels. Additional current may be generated in other applications having larger hubs or by using stronger magnets, as desired.

Instead of a dynamo, a battery, which may be of a replaceable type, may be used. A switch is placed between the battery and the light-emitting diode or lamp to prevent draining the battery when not in use, and a centrifugally driven switch may be employed to provide a flashing or flickering effect.

These and other features of the present invention may be appreciated with reference to the drawings and the written specification which follow.

DESCRIPTION OF THE PREFERRED EMBODIMENT

Figure 8:
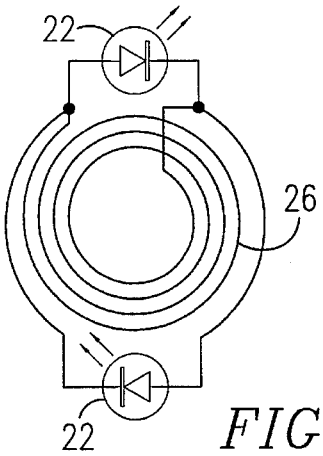
FIG. 8 is a schematic view of the alternating current dynamo electrically coupled to the light-emitting diodes for producing a flashing light.
Figure 6:
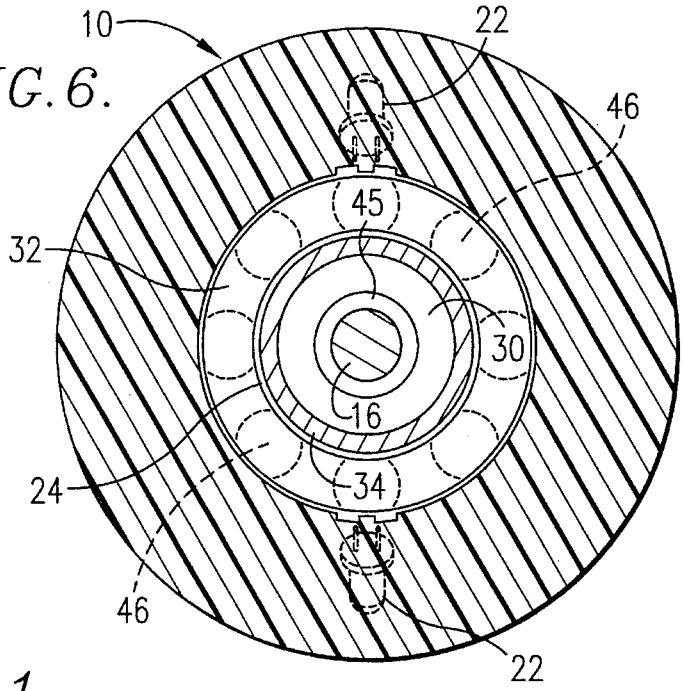
FIG. 6 is an enlarged vertical cross-sectional view taken along line 6—6 of FIG. 3 to show the multiple-pole magnet and showing the poles thereof in phantom.

Referring now to the drawing, a self-powered lighted wheel 10 in accordance with the present invention is shown rotatably mounted to the frame 12 of an in-line roller skate 14. In the embodiment illustrated, the wheel 10 rotates about a fixed axle 16, although other embodiments could be employed using a rotating axle and a fixed hub for allowing the necessary relative movement to generate current by the dynamo. The wheel 10 hereof includes a wheel hub 18 and a traction tire 20 carried thereon, and a illumination member 22 carried by the traction tire for rotation therewith during use.

Figure 2:
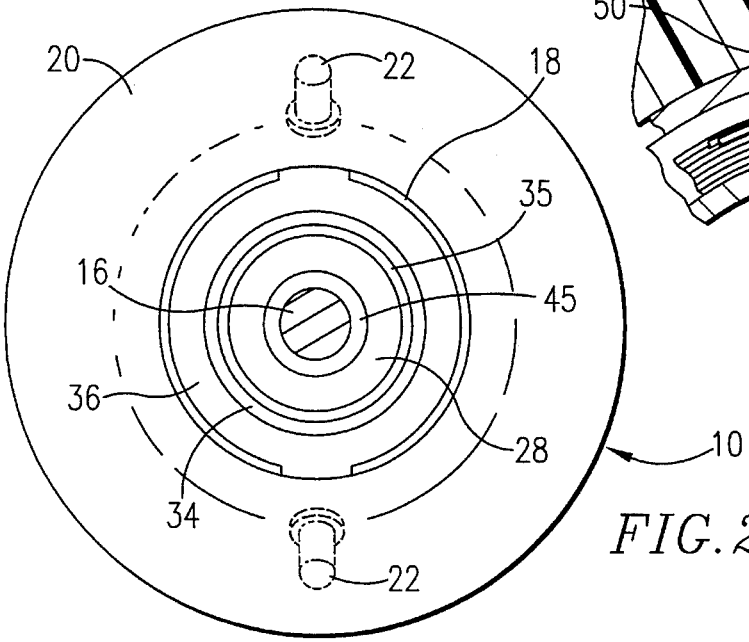
FIG. 2 is an enlarged side elevational view of the self-powered lighted wheel hereof.
Figure 4:
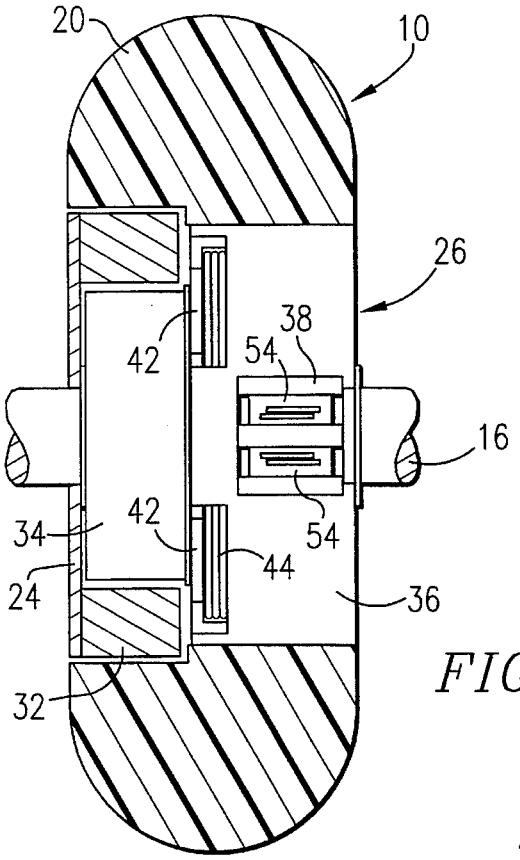
FIG. 4 is an enlarged, end, horizontal cross-sectional view through the tire with the core and sleeve of the dynamo shown in elevation to show the clip for the wire leads to the light-emitting diodes.
Figure 3:
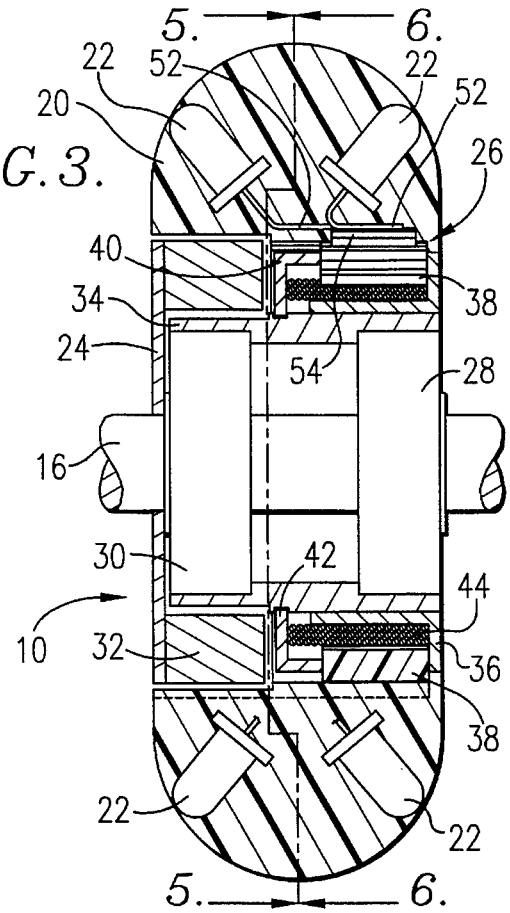
FIG. 3 is an enlarged, end, vertical cross-sectional view of the wheel hereof, showing the shaft, bearings, light-emitting diodes, and the magnets and windings of the dynamo.

As shown in greater detail in FIG. 2, the wheel 10 preferably includes a plurality of illumination members 22 disposed circumferentially about the wheel 10 and as shown in FIG. 3, disposed on both sides of a plane bisecting the wheel and normal to its axis of rotation to permit viewing of the illumination from several surrounding locations. The illumination members are preferably light-emitting diodes because of their relatively low voltage and current requirements and their applicability for use in conjunction with an AC dynamo to produce a flashing or flickering light. However, a small lamp, such as an incandescent bulb used in flashlights, could also be used with the wheel 10.

The wheel hub 18 surrounds the fixed axle 16 and includes a disc 24 fixed to the axle 16. The wheel hub 18 also includes a dynamo 26 in the annular space between the bearings 28 and 30 and the traction tire 20. The dynamo 26 includes a magnet 32 which acts as the stator, the disc 24 being coupled to the magnet 32. The magnet 32 is preferably of an annular shape presenting multiple magnetic poles 46. A set of discrete conventional magnets made of elements of metal such as iron, nickel or cobalt or alloys or mixtures thereof may be used, but I prefer the use of a ceramic five or ceramic eight magnet in this application which enables easier fabrication, installation and greater reliability. A ceramic five magnet is less expensive while a ceramic eight magnet has a slightly higher field strength. The ceramic magnet has 4, 6 or 8 poles to provide the desired current generation and/or corresponding number of illumination occurrences during rotation of the wheel. If higher current is desired for some applications, then magnets of ALNICO or rare earth magnets may be used.

Figure 5:
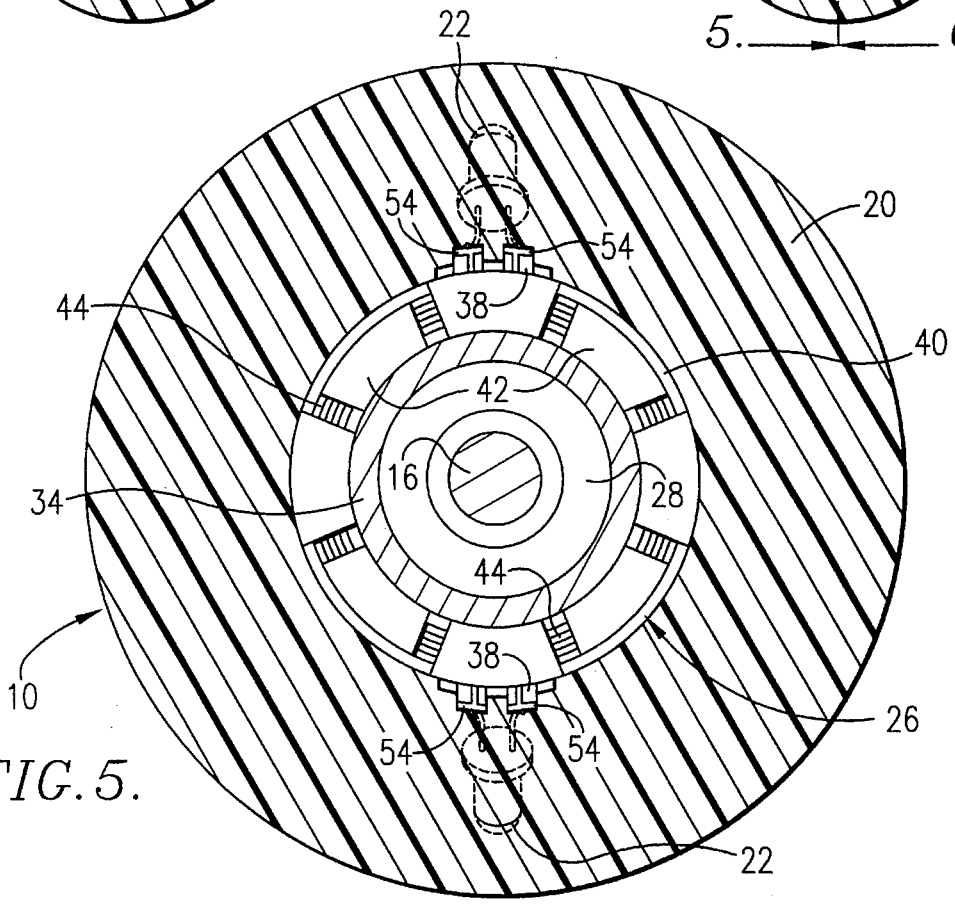
FIG. 5 is an enlarged vertical cross-sectional view taken along line 5—5 of FIG. 3 to show the bearings and the dynamo which is electrically coupled to the light-emitting diodes.

The dynamo 26 also includes a core 34 which connects to the outer ring 35 of the bearings 28 and 30 and rotates with the outer surface of the bearings and the traction tire 20. The core 34 includes a sleeve 36 which carries clips 38 which correspond to each pair of illumination members 22. The sleeve is shown in greater detail in FIG. 5 and as illustrated includes a spool 40 mounting, for example, eight brackets 42 for retaining the copper wire winding 44 thereon. The core 34 is a non-magnetically conductive and is of aluminum, although brass or a synthetic resin such as nylon could also be used. The dynamo 26 is preferably an alternating current (AC) dynamo generating current in the range of 2 to 3 volts and a current of 20 to 100 milliamps which is capable of supplying sufficient current to illuminate the two to eight light-emitting diodes functioning as illumination members 22.

The bearings 28 and 30 are conventional bearings used in existing in-line skate wheels and include ball bearings for providing minimum rolling resistance. The inner ring 45 of the bearings 28 and 30 is fixed against rotation to the axle 16.

Figure 7:
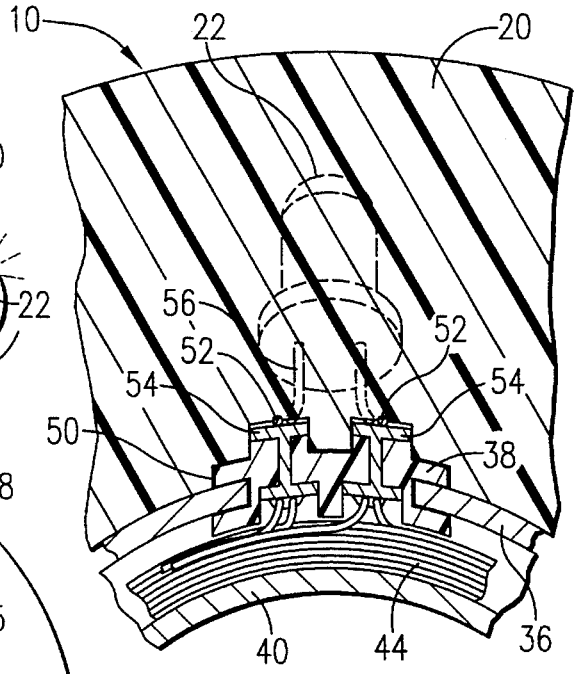
FIG. 7 is an enlarged fragmentary vertical cross-sectional view through the traction tire and clip showing the connection between the windings and the leads to the light-emitting diode.

As shown in FIG. 7, the winding 44 connects to clips 38 which are preferably of a non-conductive and resilient synthetic resin material. The clips 38 fit into corresponding and complementally configured openings 48 in the sleeve and recesses 50 defined in the traction tire 20. The winding 44 is soldered or otherwise electrically connected to the leads 52 of the respective illumination members 22 by bridges 54 of copper or other electrically conductive material. As may be seen in FIG. 3, each bridge advantageously, though not necessarily, connects the leads 56 of two illumination members 22 to the winding 44.

Figure 1:
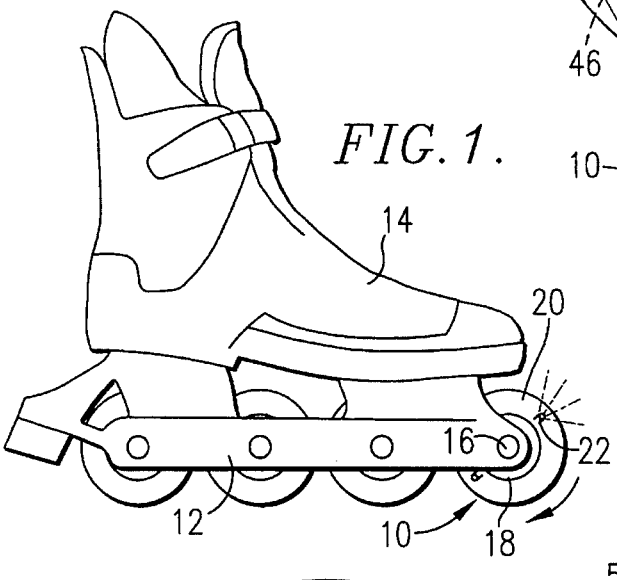
FIG. 1 is a side elevational view of an in-line skate having a frame mounting a self-powered lighted wheel in accordance with the present invention.

The traction tire 20 when used with an in-line skate or skateboard is preferably of molded urethane. If a translucent urethane traction tire is provided as shown, the light-emitting diodes used as illumination members 22 are embedded in the tire 20 as shown in FIG. 3. By including the light-emitting diodes in the tire when the tire 20 is molded, no additional installation is necessary and in use the illumination members 22 can illuminate not just as a point source but may provide a tinted and diffused light as shown in FIG. 1 to provide a greater illumination effect and make the tire 22 appear to "glow". If an opaque tire 20 is used, a small opening should be provided through the outer surface of the tire 20 to permit viewing of the illumination member in use. It may be appreciated that by drilling a cavity of a desired size, installing the illumination member therein, and securing the illumination member 22 by means of an adhesive or the like, the light-emitting diodes may be installed as an after-market item on existing tires. It may also be appreciated that the invention hereof is not limited to skate wheels, but may also be used with bicycle or automotive wheels, for example by installing the light-emitting diodes in the manner indicated above for existing traction tires on skate wheels.

The illumination members 22 are obliquely angled relative to a plane bisecting the traction tire 20 and passing transverse to the axis of rotation which is coincident with the center of the axle 16 as shown in FIG. 3. This orientation permits viewing by those at the side of the wheel 10 as well as those ahead and behind. This placement is also advantageous in limiting the effect of wear on the illumination members so that as the tire 20 wears during use, any engagement of the road surface with the illumination members will be delayed until the wheel is no longer readily useful.

As shown in FIG. 8, the dynamo 26, having multiple poles, is coupled to the light-emitting diodes so that the alternating current generated by the dynamo alternately illuminates different light-emitting diodes because of their current-receiving orientation. This ensures that in this preferred embodiment, the light-emitting diodes will utilize all of the current generation while presenting a flashing light as the current alternates and different diodes are supplied with current.

Because of the use of the clips 38 which do not require soldering or permanent securement between the leads 52 and the bridges 54, but merely a positive engagement to establish an electrical connection, the traction tire 20 may be removed and replaced without the necessity of replacing the entire wheel 10 when the tire 20 is worn. By sliding the tire 20 off (to the right as viewed in FIG. 3) the hub, the leads 52 are disengaged from the clips 38 without damage and a new tire 20 installed without the need for any tools. Because the dynamo 26 hereof is brushless, it has very low maintenance, and if the bearings 28 and 30 are secured to the core by threading, keys, pins or the like, the bearings may be removed from the core without the need for replacement of the dynamo.

In use, once the wheels 10 are mounted to the axles 16 on the frames 12, the wheel 10 is ready for use. In the normal process of rotation, the dynamo 26 will generate current. As the dynamo is electrically coupled to the illumination members 22, the illumination members 22 will emit light in response to rotation. By using an AC dynamo, translucent tires, and light-emitting diodes as the illumination members 22, the rotation of the tire 20 will produce a visual effect of the entire tire flashing light as it rotates. The resulting effect is especially interesting in a darkened arena or at night.

Although preferred forms of the invention have been described above, it is to be recognized that such disclosure is by way of illustration only, and should not be utilized in a limiting sense in interpreting the scope of the present invention. Modifications to the exemplary embodiments, as hereinabove set forth, could be readily made by those skilled in the art without departing from the spirit of the present invention.

For example, it is within the scope of this invention to use a battery housed within the rotating wheel which can either be permanently or removably mounted and coupled to an illuminating member through a manual and/or centrifugal switch. With a manual switch, the illuminating member would emit light so long as the switch was closed and current passed from the battery to the illuminating member. A centrifugal switch or electronic circuitry including a capacitor could be provided to provide a flashing effect or electrically couple the lamp to the battery only during rotation of the tire. It would also be within the scope of the invention to substitute a direct current dynamo for generating electrical current instead of the alternating current dynamo previously described. While light emitting diodes and incandescent lamps have been mentioned as exemplary illumination members, it is also understood that other types of light generators, such as a neon light bulb, could be employed as an illuminating member. The dynamo may be incorporated within or carried by other rotational members and use gravity or alternatively a stationary member adjacent to the wheel to maintain the other component stationary to illuminate a lamp or light-emitting diode carried on the rotating wheel, such as might be used as a support wheel in a bicycle or automobile.

The inventor hereby states his intent to rely on the Doctrine of Equivalents to determine and assess the reasonably fair scope of his invention as pertains to any apparatus not materially departing from but outside the liberal scope of the invention as set out in the following claims.

I claim:

1. A wheel rotatable about an axis of rotation comprising:

a wheel hub including a pair of electrically conductive bridges;

a traction tire removably mounted on said hub, said tire being divisible into first and second sides about a plane substantially bisecting said tire and normal to the axis of rotation;

a dynamo carried by said hub; and a plurality of illumination members electrically coupled to said dynamo and carried by said traction tire for emitting a light in response to electrical current supplied by said dynamo during rotation of said wheel, at least one of said illumination members being disposed on each of said sides of said plane, said illumination members including a pair of electrical leads slidably electrically connected to said bridges.

2. A wheel as set forth in claim 1, wherein said traction tire is made of a translucent material and said illumination members are imbedded in said tire for diffusing light from said illumination members through said tire.

3. A wheel as set forth in claim 1, wherein at least one of said illumination members is oriented at an oblique angle relative to said plane.

4. A wheel as set forth in claim 3, wherein said traction tire presents a surface portion arcuate transversely to said plane and said at least one of said illumination members is substantially oriented substantially tangentially thereon.

5. A wheel as set forth in claim 1, wherein said dynamo includes a permanent magnet and a core carrying electrically conductive windings thereon, said magnet and said core being located in side-by-side orientation.

6. A wheel as set forth in claim 1, wherein said dynamo includes a permanent magnet having at least four poles.

* * * * *